US007891055B1

(12) United States Patent
Combs

(10) Patent No.: US 7,891,055 B1
(45) Date of Patent: Feb. 22, 2011

(54) REPLACEMENT HINGE PIN

(76) Inventor: Gary Combs, 3119 Strathmore Cir. SW., Tumwater, WA (US) 98512

( * ) Notice: Subject to any disclaimer, the term of this patent is extended or adjusted under 35 U.S.C. 154(b) by 708 days.

(21) Appl. No.: 11/341,145

(22) Filed: Jan. 27, 2006

(51) Int. Cl.
*E05C 17/64* (2006.01)

(52) U.S. Cl. ..... 16/342; 16/341; 16/386

(58) Field of Classification Search ..... 16/342, 16/386, 341
See application file for complete search history.

(56) References Cited

U.S. PATENT DOCUMENTS

| | | | | | |
|---|---|---|---|---|---|
| 1,484,536 | A | * | 2/1924 | Way | 16/242 |
| 1,900,081 | A | | 3/1933 | Swerer | |
| 1,908,383 | A | * | 5/1933 | Vice | 16/242 |
| 2,533,502 | A | * | 12/1950 | Philips | 16/242 |
| 2,719,322 | A | * | 10/1955 | Hager et al. | 16/380 |
| 3,013,297 | A | * | 12/1961 | Ferry | 16/381 |
| 3,805,325 | A | * | 4/1974 | Lee | 16/262 |
| 4,603,452 | A | * | 8/1986 | Paciorek | 16/262 |
| 4,734,955 | A | * | 4/1988 | Connor | 16/332 |
| 4,748,717 | A | * | 6/1988 | Osborne | 16/240 |
| 4,864,690 | A | | 9/1989 | Chen | |
| 5,630,519 | A | * | 5/1997 | Burke et al. | 213/155 |
| 5,761,769 | A | * | 6/1998 | Bruckner et al. | 16/342 |
| 6,349,449 | B1 | * | 2/2002 | Kuehl | 16/342 |
| 6,591,450 | B2 | | 7/2003 | Gardner | |
| 6,804,862 | B2 | * | 10/2004 | Miller | 16/386 |

* cited by examiner

*Primary Examiner*—Shane Bomar
*Assistant Examiner*—Roberta Delisle
(74) *Attorney, Agent, or Firm*—Brian J. Coyne

(57) ABSTRACT

A replacement hinge pin to cure the problem of an open door that swings waywardly under the influence of gravity. The pin has a pair of oppositely-disposed and oppositely-directed bulges for frictional engagement with the roll-formed knuckles of a butt hinge. Rotational adjustment of the pin increases the friction in the hinge enough to prevent a door from swinging waywardly.

5 Claims, 5 Drawing Sheets

REPLACEMENT HINGE PIN

CROSS REFERENCE TO RELATED APPLICATIONS

None

STATEMENT REGARDING GOVERNMENT SPONSORED RESEARCH

None

BACKGROUND OF THE INVENTION

1. Field of the Invention

The present invention relates to door hinges generally; more particularly, the invention relates to a pin for a door hinge that overcomes the problem of a door's swinging away, under the influence of gravity, from a user's chosen open position for the door to some other position.

2. Background Art

Doors mounted on hinges over wall openings in buildings, cabinetry, motor vehicles, et cetera, tend to develop malfunctions over time. Of particular interest for the present invention are door hinges of the kind that comprise two hinge plates or leaves that are assemblable to form a butt hinge, each hinge leaf having one or more pintle journals or knuckles, wherein the knuckles are complementarily spaced apart so as to be interleaveable on a common axis, and wherein each of the knuckles defines an open chamber for receiving a hinge pin. In the case of doors mounted on two or more such butt hinges that are vertically aligned to permit the door to swing about a vertical axis, the hinges may become misaligned and/or the hinges may become so worn by use that the hinges develop excessive play; in either case, an attempt to leave the door in a desired open position may result in the door's swinging by gravity to some other position.

U.S. Pat. No. 1,900,081 issued to Swerer disclosed an adjustable hinge having a first set of vertically-spaced knuckles attachable by a jamb plate to a door jamb and a second set of vertically-spaced knuckles attachable by a door-engaging plate to a door. The knuckles within each set were concentrically aligned with each other, but the two sets of knuckles were ordinarily positioned out of axial alignment with each other. A hinge pin, preferably of hexagonal transverse cross-section, carried cylindrically-shaped eccentrics such that rotational adjustment of a lower, protruding end of the pin would alter the distance between the door and the jamb.

U.S. Pat. No. 1,908,383 issued to Vice disclosed an adjustable hinge comprising a pair of cooperating hinge plates having interleaved pintle journals that extended into the spaces between the journals. A lower portion of the hinge pin was of non-circular cross-section and adapted to insert into slots or grooves formed in eccentrics. One eccentric was provided for insertion and retention within each of the pintle journals, and each eccentric consisted of a cylindrical body. To install the eccentric pin structure, the hinge plates of a standard butt hinge were separated and the journals reamed out to receive the eccentrics in order to relatively adjust the plates of the hinge and thereby to properly adjust the position of the door within a wall opening.

U.S. Pat. No. 2,533,502 to Philips disclosed a hinge pin that could be employed as a replacement unit for hinge pins already installed. The replacement pin had bearing portions axially aligned to form bearings in the knuckles of one of the hinge leaves; alternately disposed, reduced-diameter crank portions formed on the pin for positioning in the knuckle bores of the companion hinge leaf; and eccentric bushings mounted on the crank portions of the pin. Each bushing was longitudinally split open to permit seating upon a reduced-diameter crank portion of the pin. Means was provided for rotating the pin once it was installed within a hinge, such as a kerf in the head of the pin, rotatable by a coin or screwdriver.

U.S. Pat. No. 4,864,690 to Chen disclosed a butt hinge intended to substantially eliminate the friction that results when two or more hinges on a door become misaligned and to permit up to at least a 5° deviation of the hinge pin in either direction. The hinge mainly comprised a set of hinge butts, a center shaft insertable through the cylinder of the hinge butts and having a ball-shaped part in a mid-portion thereof, and two sets of ball bearings mounted on upper and lower ends of the ball-shaped part to provide a rolling friction between the center shaft and the butts.

U.S. Pat. No. 6,591,450 B2 to Gardner disclosed a door hinge comprising a knuckle with a cylindrical opening and having a mounting plate for mounting to a door; a mounting bracket for attachment to a door frame and having a pair of apertured flanges spaced apart to receive the knuckle therebetween; and a hinge pin insertable through the flange apertures and through the knuckle opening when the apertures and the knuckle opening were coaxially aligned, thereby to connect the knuckle and attached door to the mounting bracket. The pin had an intermediate ball part that fit snugly within the knuckle opening and opposing extended shanks that were fitted freely to permit transverse movement of the shanks within the knuckle opening. Consequently, a door mounted on two or more such hinges could swing freely and without excessive friction even if the hinges were misaligned.

The foregoing references do not adequately address the problem of a waywardly swinging door that is mounted somewhat askew to a door frame by butt hinges. To minimize time, labor and expense, it is desirable to be able to retain the existing butt hinges in position and to replace only the hinge pins with hinge pins that, merely by rotational adjustment of the pins, will introduce just enough friction into the hinges to eliminate the problem. Vince required reaming out the journals to receive his eccentrics. The solutions offered by Swerer, Chen and Gardner would require replacement of the existing butt hinges with their own novel hinges. Phillips teaches replacement of only the hinge pin, but his hinge pin is unnecessarily complicated for the limited purpose addressed by the present invention.

SUMMARY OF THE INVENTION

There remains, therefore, a need, for which the present invention provides a solution, for a replacement hinge pin that, by rotational adjustment of the replacement pin will introduce just enough additional friction into a butt hinge to cure the problem of a hinged door that swings waywardly under the influence of gravity—a door that, when open, just will not stay put; a pin, moreover, that is simple in construction, inexpensive, and foolproof to install. In a preferred embodiment, the replacement hinge pin is intended for use with the type of door hinge that has two hinge leaves assemblable to form a butt hinge, wherein each leaf has knuckles complementarily spaced apart to permit interleaving alignment of the knuckles on a common longitudinal axis and each knuckle defines an open pin chamber. The pin chambers in this type of butt hinge are not cylindrical, however; instead, they are elliptical in transverse cross-section due to the manner in which the knuckles are roll-formed during manufacture. The replacement hinge pin includes a cylindrical shank, a head at a free end of the pin, and a collar intermediate the head and the shank. Distributed longitudinally at intervals along the shank are oppositely disposed and oppositely-directed pairs of bulges—a pair of bulges for at least one knuckle of the hinge, and preferably a pair for each of the knuckles. When the knuckles of the two leaves are interleaved and aligned, and the pin is inserted through the pin chambers, rotational adjustment of the pin, such as by a screwdriver inserted into a kerf in the head of the pin, causes the bulges to force the oppositely-disposed, inner surfaces of the pin chambers apart. In this manner, just enough additional friction can be introduced into the hinge to compensate for a skew-mounted door's tendency to swing under the influence of gravity.

DETAILED DESCRIPTION OF THE PREFERRED EMBODIMENT

Figure 1:
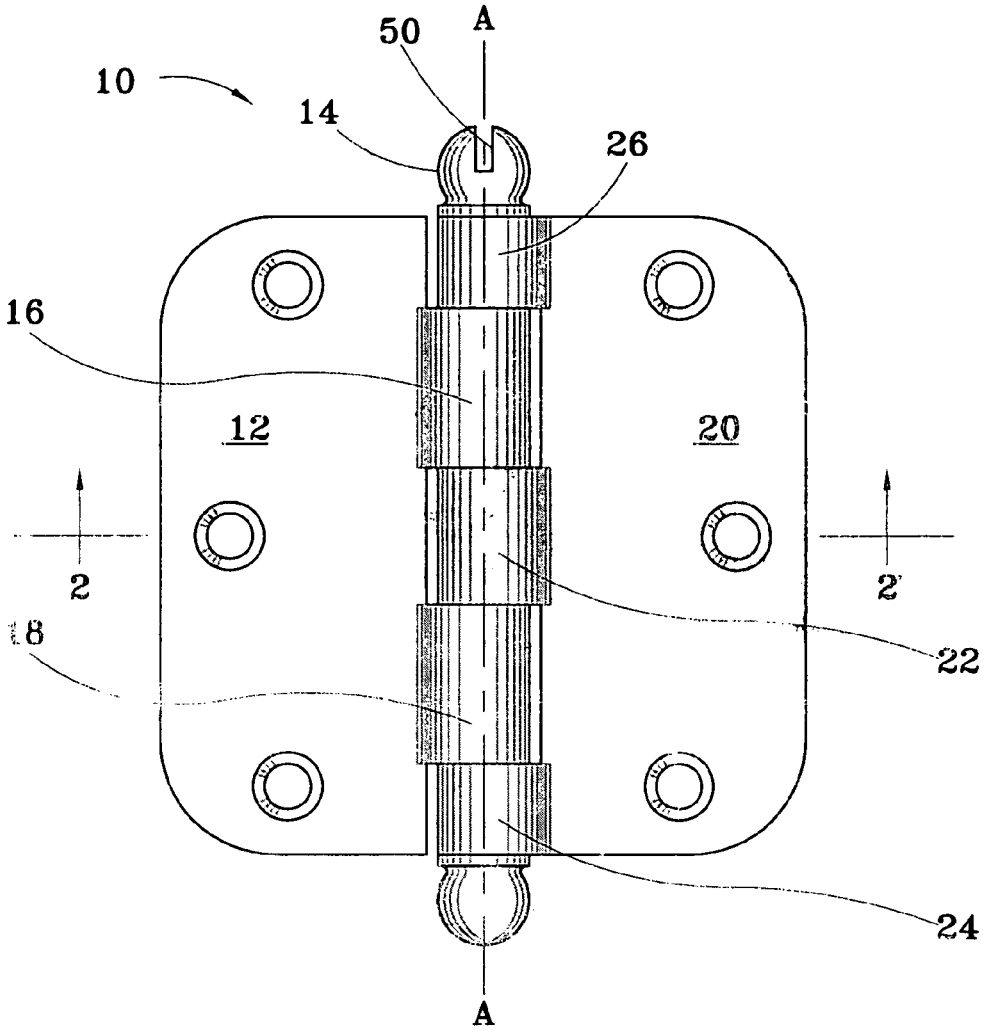
(PRIOR ART) FIG. 1
FIG. 1 is a front face view of a type of butt hinge of the prior art that has roll-formed knuckles.
Figure 2:
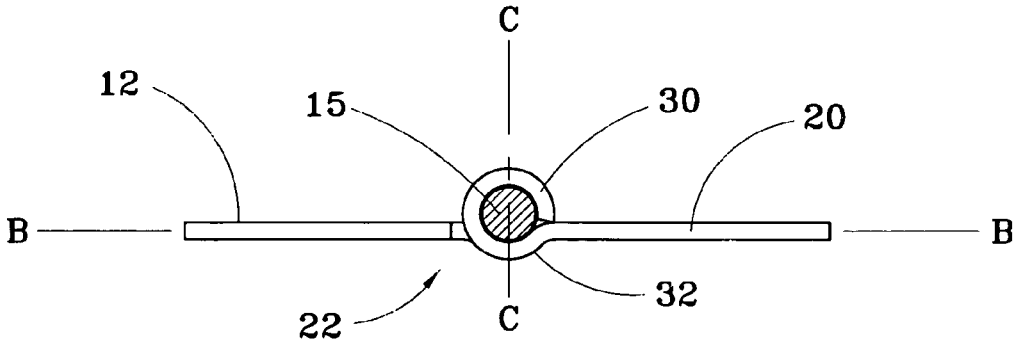
(PRIOR ART) FIG. 2
FIG. 2 is a transverse, cross-sectional view thereof taken along line 2-2 of FIG. 1.
Figure 3:
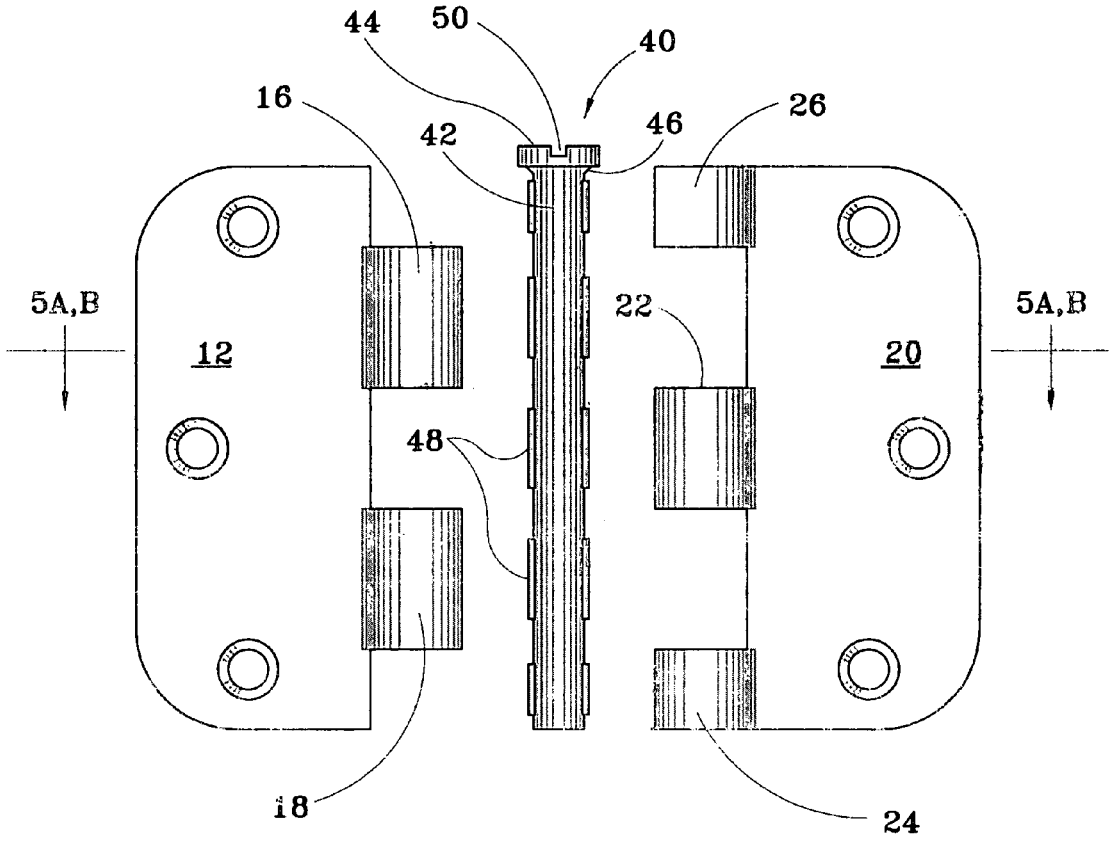
FIG. 3 is a front face view of a butt hinge with roll-formed knuckles from which the original equipment hinge pin has been removed and the hinge leaves separated for clarity of view, and showing how the bulges of my replacement hinge pin are disposed along the pin to correspond to the locations of the knuckles.
Figure 4:
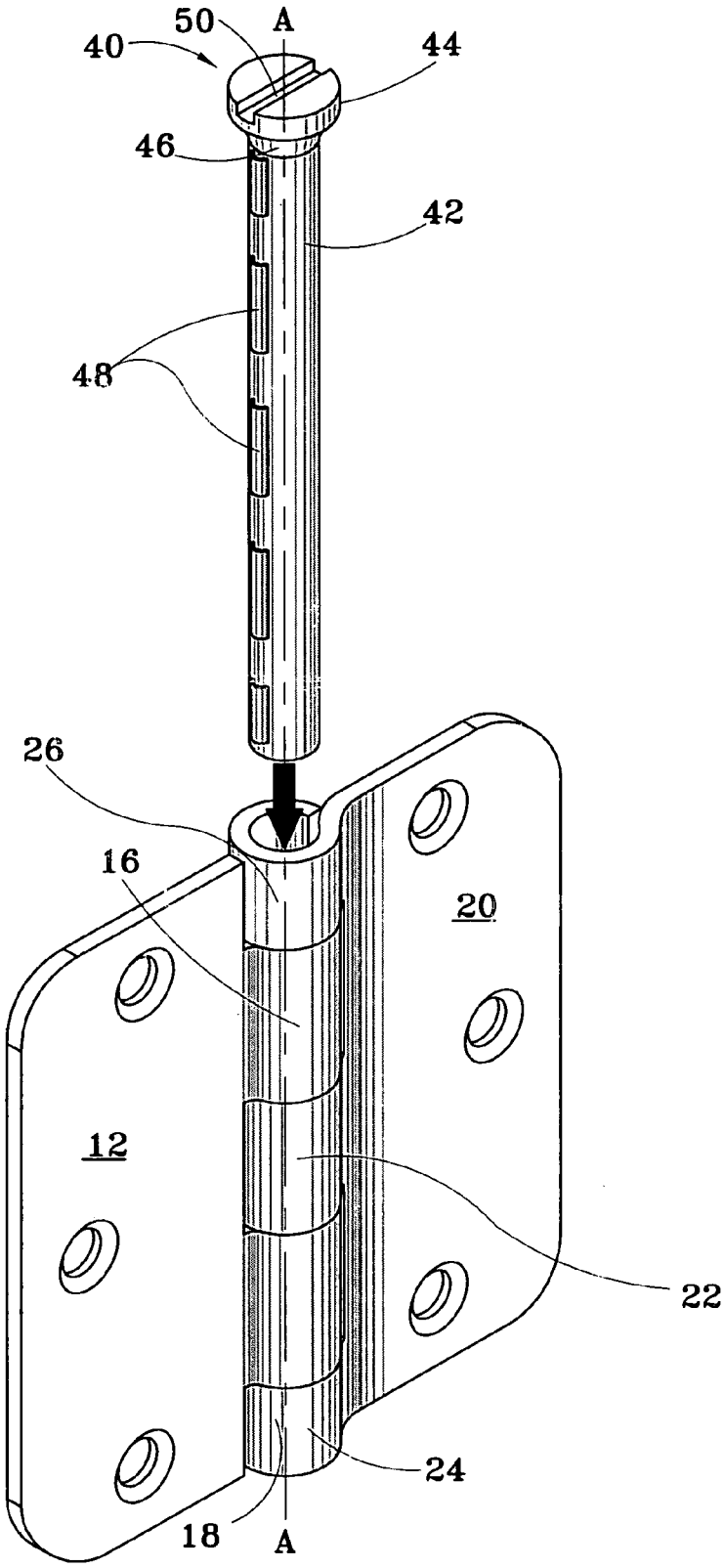
FIG. 4 is a frontal perspective view of the same wherein the knuckles are now interleaved and aligned and ready for insertion of my replacement hinge pin.

A butt hinge 10 of the prior art is depicted in FIGS. 1 and 2, comprising a first hinge leaf 12 having two knuckles 16, 18, a second hinge leaf 20 having three knuckles 22, 24, 26 interleaved on a common axis A-A with the knuckles 16, 18, and a hinge pin 15 inserted through pin chambers within the knuckles 16, 18, 22, 24, 26. The hinge pin 15 has a cylindrical shaft of uniform diameter and terminates at an upper end in a head 14 into which has been cut a kerf 36. Representative of all the knuckles is knuckle 22, shown in transverse cross-section in FIG. 2, wherein it may be seen that in this type of butt hinge the knuckles are roll-formed; that is, a leading edge 30 of a tab extension 32 of a hinge leaf 20 has been rolled around and back upon itself to form the knuckle 22. Consequently, the pin chambers defined by the knuckles 16, 18, 22, 24, 26 are slightly elliptical in transverse cross-section, having major axis B-B and minor axis C-C, as depicted in FIG. 2.

Figure 5A:
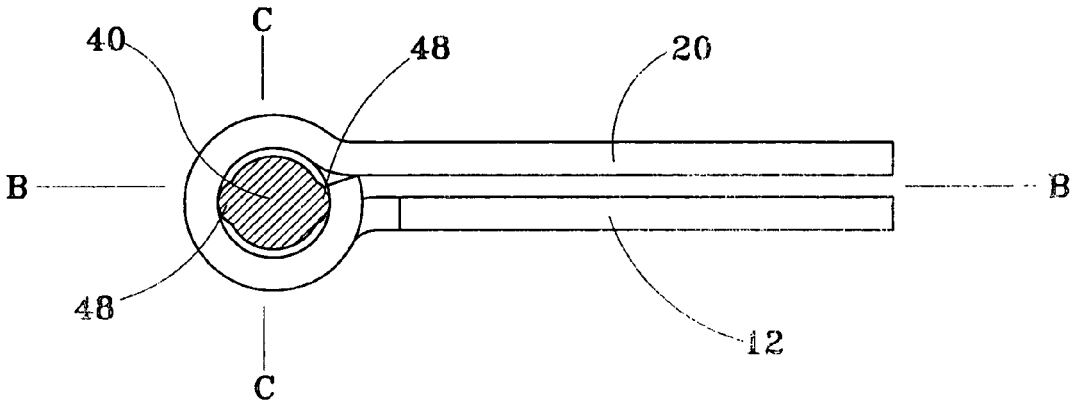
FIG. 5A is an enlarged, transverse cross-sectional view of the butt hinge of FIG. 3 after the knuckles of the mating hinge leaves have been aligned and interleaved and my replacement hinge pin inserted through the pin chambers of the knuckles, taken along line 5A, and with the leaves in a closed position.
Figure 5B:
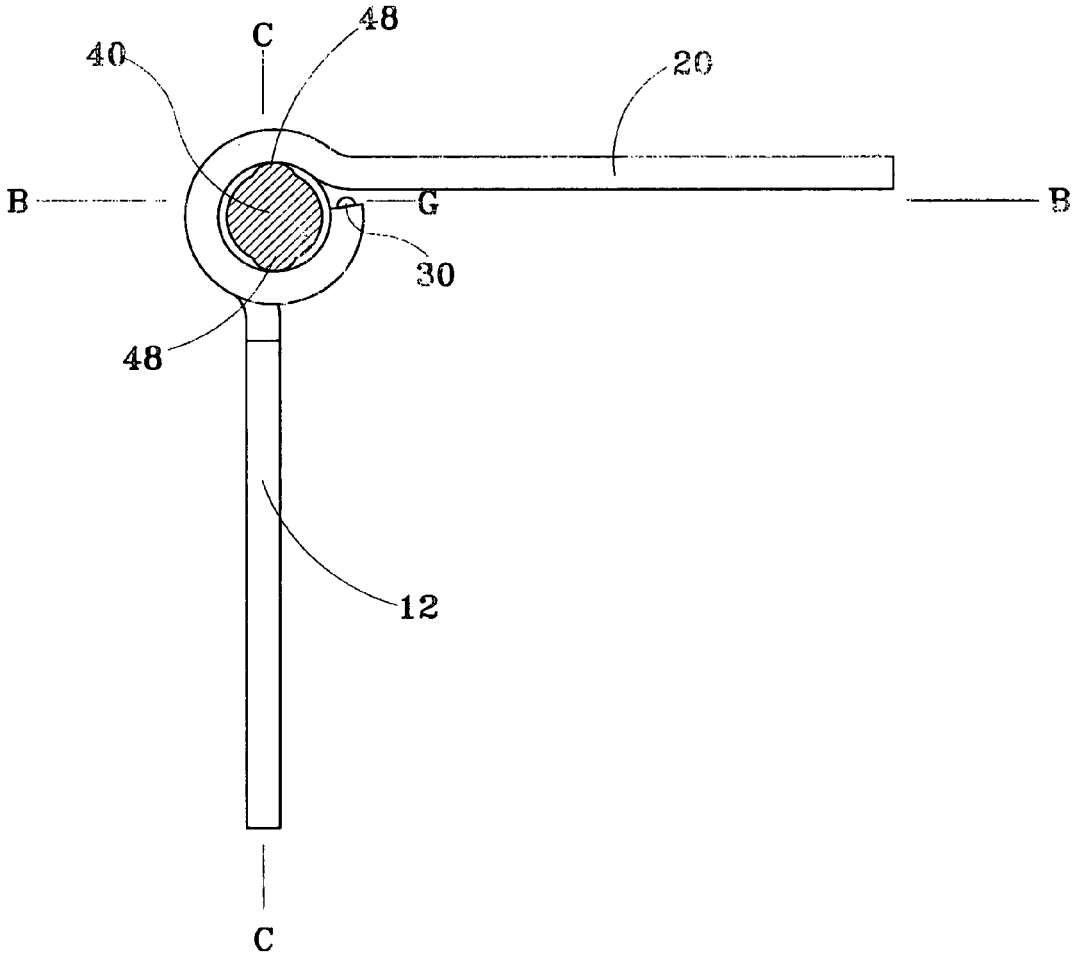
FIG. 5B is the same view as FIG. 5A except that the leaves are here shown in an open position.

As depicted in FIGS. 3, 4, 5A and 5B, my hinge pin 40 comprises a cylindrical shank 42, a head 44 at an upper, free end of the pin, and a collar 46 intermediate the head and the shank. The pin 40 further includes pairs of oppositely-disposed and oppositely-directed bulges 48 uniformly distributed along the shank 42—one pair corresponding to the location of each of the knuckles 16, 18, 18, 22, 24, 26 when the pin 40 is fully inserted into all the pin chambers thereof; see FIG. 3. The pin further includes index means—e.g., a kerf 50 cut into the head 44—to facilitate alignment of the bulges 48 coplanar with the major axes B-B of the knuckles. In a first rotational disposition of the pin 40, the bulges 48 can be oriented by an installer along the major elliptical axis B-B of a representative knuckle 16, as shown in FIG. 5A, for the situation in which the hinge leaves 12, 20 are in a closed position (i.e., the fixed hinge leaf 20 is attached to a door frame, the movable hinge leaf 12 is attached to a door, and the door is closed). Thereafter, as depicted in FIG. 5B, rotation of the hinge leaf 12 to an open position (i.e., the door is open) causes the pin 40 to rotate such that the bulges 48 align more or less with the minor axis C-C of the knuckles, thereby forcing the oppositely-disposed inner surfaces of the pin chambers apart. This action opens a gap G in the knuckle 16 at the leading edge 30 thereof due to the inherent resiliency of the material from which the knuckles are formed—typically, brass sheet metal. The result is increased friction between the pin 40 and the interior surfaces of the knuckles 16, 18, 22, 24, 26, which reduces or eliminates the tendency of a door to swing waywardly under the influence of gravity. The amount of increase in friction can be adjusted by rotating the pin 40, when the door is open, throughout a range—namely, from a position in which the bulges 48 are aligned with the major axes B-B to a position in which they align with the minor axes C-C, or to any position in between those extremes. Methods for manufacture of my pin are within the skill and knowledge person experienced in the manufacture of door hinges and can include, for example, drop force, casting and/or machining.

Figure 6:
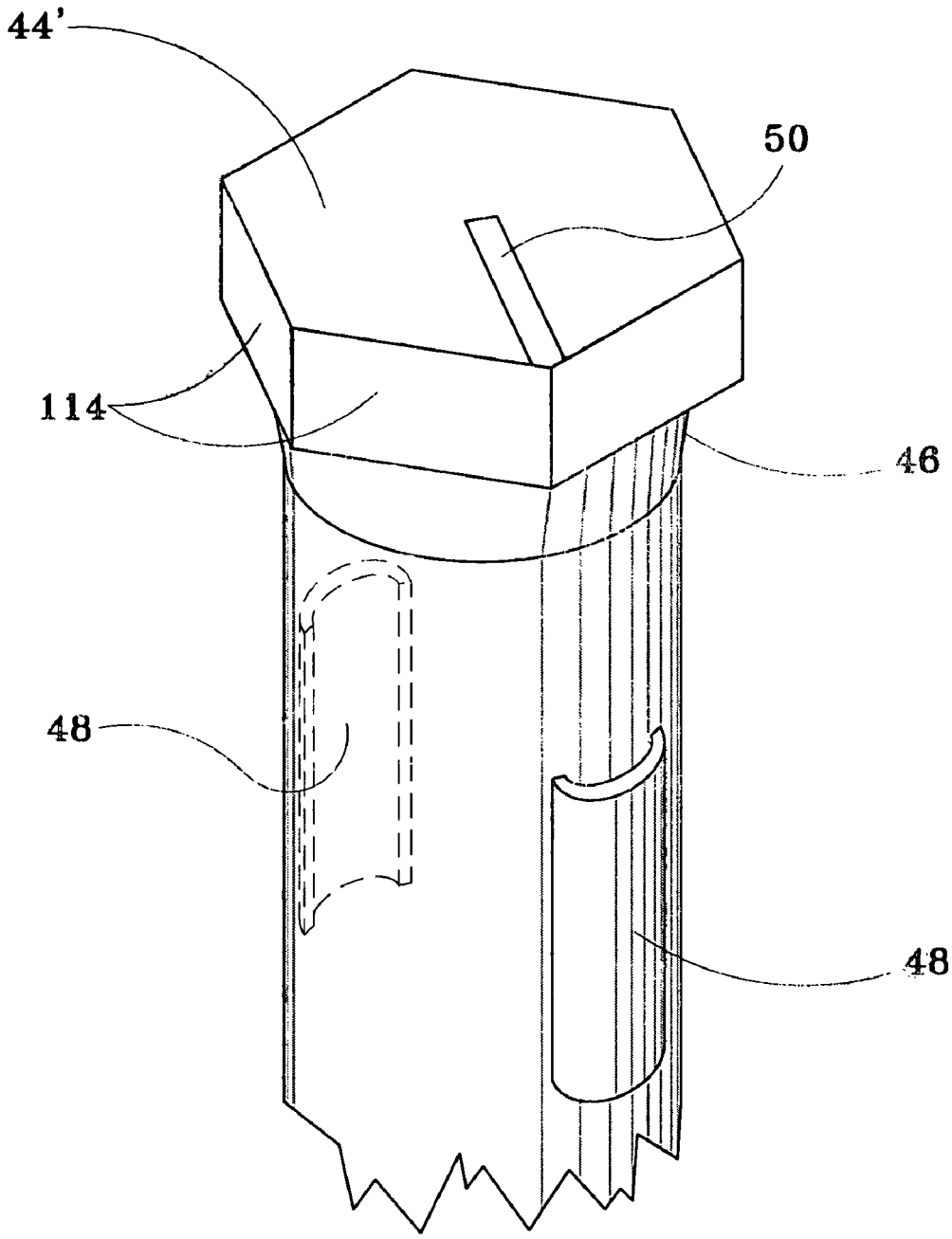
FIG. 6 is an enlarged, fragmentary perspective view of a version of my pin having a hexagonal-faced head.

From the foregoing description, it will be clear that the present invention may be embodied in other specific forms without departing from the sprit or essential characteristics thereof. It will be understood for instance, that the number of pairs of bulges 40 may be increased or decreased from the five pairs described above, to match the number of knuckles of the butt hinge needing a replacement pin. Further, the index means could be either a kerf or a radially-directed, inscribed line 50 in the head, but the head itself could be a hexagonally-shaped head 44' with hexagonal faces 114 and adjustable with a hex wrench; see FIG. 6. Moreover, the preferred embodiment of the pin has a collar intermediate the head the shank, but the pin can be made to work even without the collar. The collar tends to keep the pin stationary with respect to whichever leaf has the knuckle that surrounds the collar. Thus, the presently disclosed embodiment is therefore to be considered in all respects as illustrative and not restrictive, the scope of the invention being indicated by the appended claims, and not limited to the foregoing description.

I claim:

1. A pin for a door hinge, said hinge having two hinge leaves assemblable to form a butt hinge, each leaf having knuckles complementarily spaced apart to permit alignment of the knuckles on a common longitudinal axis, each of said knuckles being roll-formed and defining an open pin chamber that is elliptical in transverse cross-section and having oppositely disposed, inner surfaces, wherein the pin includes a cylindrical shank, a head at a free end of the pin, and a collar intermediate the head and the shank, said collar having a diameter larger than the diameter of the shank, and the shank has a pair of bulges for each of the knuckles, said bulges adapted to contact inner surfaces of a pin chamber when the pin is inserted through aligned knuckles of the leaves, said bulges of each pair being oppositely disposed and oppositely directed, such that when a leaf is rotated about the pin from a closed hinge position to an open hinge position, the bulges force apart the oppositely disposed, inner surfaces of each pin chamber contacted by the bulges.

2. The pin of claim 1, wherein the head of the pin has index means to facilitate alignment of the bulges coplanar with the major axes of the knuckles of the hinge leaves during installation of the pin into the hinge.

3. The pin of claim 2, wherein the index means is a kerf cut into an upper surface of the head of the pin.

4. The pin of claim 3, wherein the index means comprises hexagonal faces on the head such that the head can be rotated by a hex wrench.

5. The pin as in any of claims 1-4, wherein a first leaf has three knuckles, a second leaf has two knuckles, and the pin has five pairs of bulges.

* * * * *